US009418600B2

(12) United States Patent
Liang et al.

(10) Patent No.: US 9,418,600 B2
(45) Date of Patent: Aug. 16, 2016

(54) APPARATUS FOR CONTROLLING A DISPLAY AND METHOD THEREOF

(75) Inventors: Ren Kuan Liang, Hsinchu Hsien (TW); Chao-Chi Yeh, Hsinchu Hsien (TW); Chih-Liang Wang, Hsinchu Hsien (TW)

(73) Assignee: MStar Semiconductor, Inc. (TW)

( * ) Notice: Subject to any disclaimer, the term of this patent is extended or adjusted under 35 U.S.C. 154(b) by 724 days.

(21) Appl. No.: 12/788,992

(22) Filed: May 27, 2010

(65) Prior Publication Data

US 2010/0302133 A1 Dec. 2, 2010

Related U.S. Application Data

(60) Provisional application No. 61/181,288, filed on May 27, 2009.

(51) Int. Cl.
*G09G 3/34* (2006.01)

(52) U.S. Cl.
CPC ..... *G09G 3/3426* (2013.01); *G09G 2320/0646* (2013.01); *G09G 2360/16* (2013.01)

(58) Field of Classification Search
CPC ..... G09G 3/342
USPC ..... 345/102
See application file for complete search history.

(56) References Cited

U.S. PATENT DOCUMENTS

| | | | | |
|---|---|---|---|---|
| 2007/0285379 | A1 * | 12/2007 | Jung et al. | 345/102 |
| 2009/0002400 | A1 * | 1/2009 | Ha et al. | 345/690 |
| 2009/0122003 | A1 | 5/2009 | Chen et al. | |
| 2010/0020005 | A1 * | 1/2010 | Jung et al. | 345/102 |

FOREIGN PATENT DOCUMENTS

| | | |
|---|---|---|
| CN | 1160224 A | 9/1997 |
| JP | 2006-134780 | 5/2008 |

* cited by examiner

*Primary Examiner* — Dennis Joseph
(74) *Attorney, Agent, or Firm* — Han IP Corporation

(57) ABSTRACT

An apparatus for controlling a display having a backlight module provided with a first set of units and a display panel provided with a second set of units is provided. In one embodiment, the apparatus comprises a reference value generator, a control value generator, and a compensation circuit. The reference value generator generates a reference value representative of a portion of pixels contained in an input image associated with one of the second set of units. The control value generator generates a control value to control one of the first set of units in view of the reference value. The compensation circuit adjusts the portion of pixels contained in the input image in view of the control value. The one of the first units is associated with the one of the second units.

14 Claims, 5 Drawing Sheets

APPARATUS FOR CONTROLLING A DISPLAY AND METHOD THEREOF

CROSS REFERENCE TO RELATED PATENT APPLICATIONS

This patent application claims priority from U.S. Provisional Patent Application No. 61/181,288, filed on May 27, 2009, entitled "Apparatus for Controlling a Display and Method Thereof", which is hereby incorporated in its entirety by reference.

TECHNICAL FIELD

The present disclosure relates to a backlight control mechanism of a display panel, and more particularly, to a control apparatus and an associated control method capable of dynamically adjusting a backlight luminance according to a reference value.

BACKGROUND OF THE PRESENT DISCLOSURE

A backlight source applied to a liquid crystal display (LCD) is realized via two types of components—a cold cathode tube and a light emitting diode (LED). Although the well-developed and low-cost cold cathode tube technology is widely used in various types of electronic display apparatuses, an LED backlight source consumes less power than the cold cathode tube backlight source when achieving a same luminance level as that of a cold cathode tube backlight source, such that electronic display apparatuses with LED backlight sources have become publicly available. However, luminance control and associated operations of the LED backlight sources are not yet thoroughly researched in the prior art.

SUMMARY OF THE PRESENT DISCLOSURE

Therefore, an object of the present disclosure is to provide a control apparatus and a control method capable of dynamically adjusting backlight luminance of different backlight units according to reference values of an input image corresponding to different pixel regions. The control apparatus properly reduces or increases backlight luminance of different backlight units, and then compensates pixel values of the input image to display an ideal image luminance. Therefore, the control apparatus and the control method are provided with advantages of having power saving and enhanced dynamic contrast.

According to an embodiment of the present disclosure, an apparatus, for controlling a display having a backlight module provided with a first set of units and a display panel provided with a second set of units, comprises a reference value generator, a control value generator, and a compensation circuit. The reference value generator is for generating a reference value representative of a portion of pixels contained in an input image associated with one of the second set of units. The control value generator is for generating a control value to control one of the first set of units in view of the reference value. The compensation circuit is for adjusting the portion of pixels contained in the input image in view of the control value. The one of the first units is associated with the one of the second units.

According to another embodiment of the present disclosure, a method, for controlling a display having a backlight module provided with a first set of units and a display panel provided with a second set of units, comprises generating a reference value representative of a portion of pixels contained in an input image associated with one of the second set of units; generating a control value to control one of the first set of units in view of the reference value; and adjusting the portion of pixels contained in the input image in view of the control value. The one of the first units is associated with the one of the second units.

DETAILED DESCRIPTION OF THE PREFERRED EMBODIMENT

Figure 1:
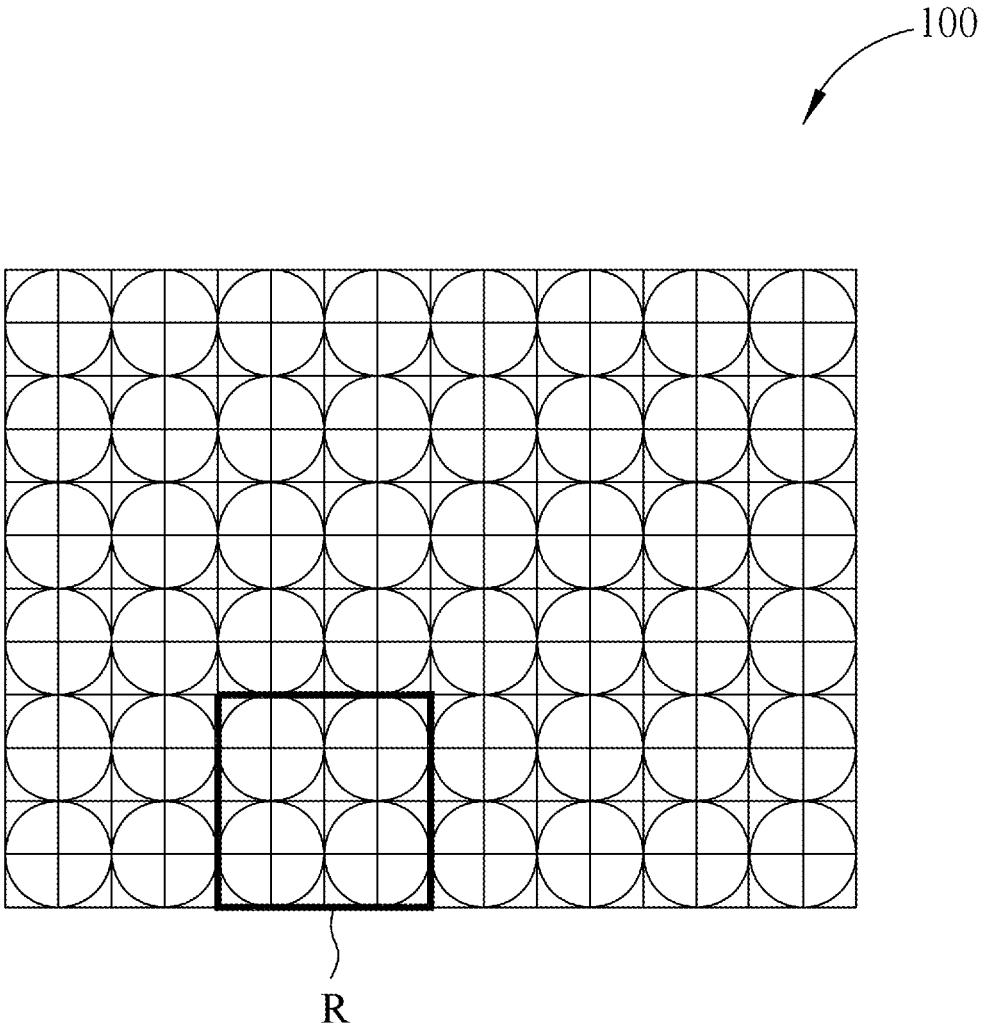
FIG. 1 is a schematic diagram of a structure of a display comprising a plurality of LED backlight sources and a display panel in accordance with an embodiment of the present disclosure.

FIG. 1 shows a schematic diagram of a display 100 having a backlight module comprising a plurality of LED backlight sources and a display panel in accordance with an embodiment of the present disclosure. Each of circles in FIG. 1 represents an LED backlight source, and four square regions illuminated by each of the circles are four pixel regions each comprising a plurality of pixels, or only one single pixel (i.e., each of the pixel regions represents only one single pixel). Each of the LED backlight sources in FIG. 1 is designed as emitting backlight intended for illuminating the four pixel regions as described, and the LED backlight sources are arranged in an array. Different LED backlight sources can emit backlight having different luminance, or the display 100 can control the LED backlight sources via a local control approach to reduce cost of control circuits. For example, four adjacent LED backlight sources are regarded as one backlight unit, such that all of the LED backlight sources are divided into a plurality of backlight units each receiving a same group of control signals. In other words, four backlight sources in each of the backlight units generate backlight having a same luminance to the display panel. However, the foregoing local control approach is for illustrating operations of the display 100 and shall not be construed as limiting the display 100 of the present disclosure, and other variations can also be applied to the display 100. In addition to the plurality of backlight sources and the display panel, the display 100 in this embodiment further comprises a control apparatus 200 for controlling the plurality of backlight sources and the display panel.

Figure 2A:
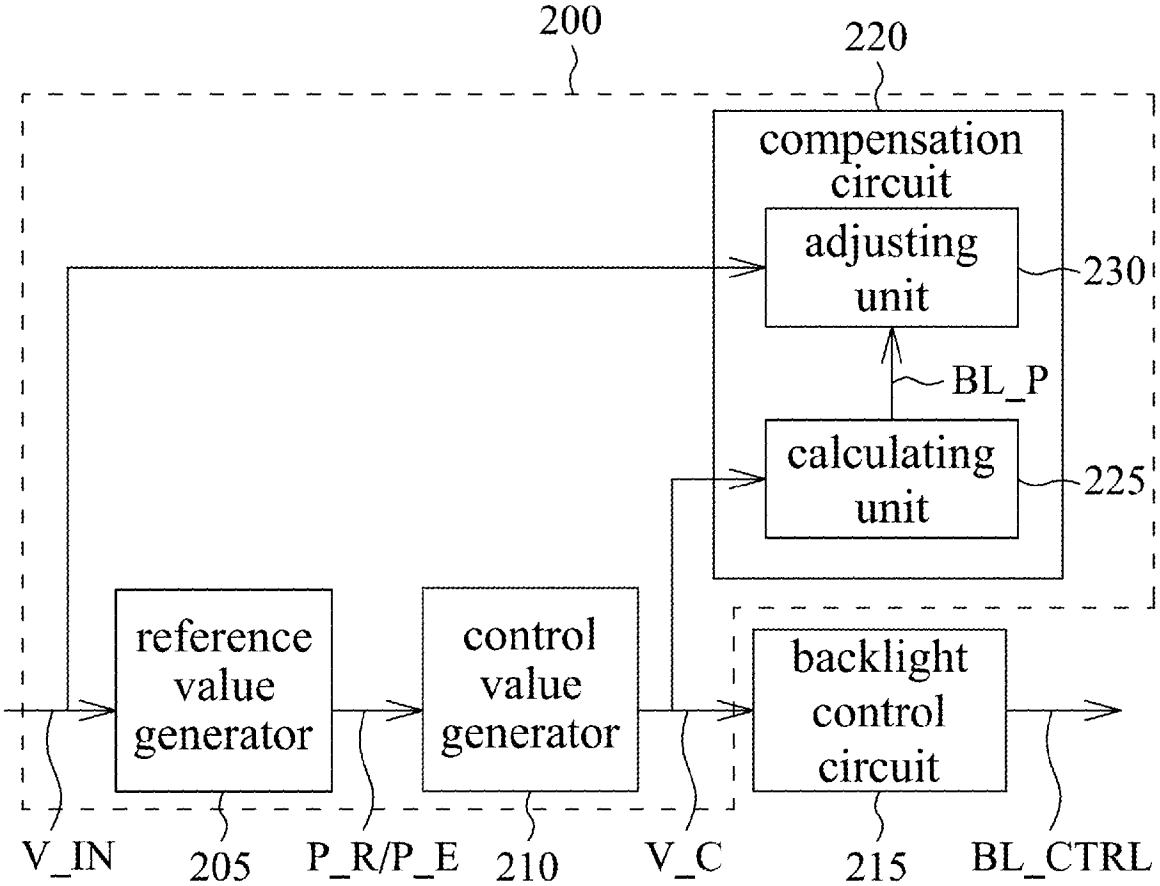
FIG. 2A is a block diagram of a control apparatus for controlling the backlight sources and the display panel in FIG. 1.

Since a luminance of an image frame displayed by an LCD display is contributed by a backlight luminance together with a gray scale value (i.e., a transmittance) of LCD molecules, the control apparatus 200 maintains the luminance of the image frame displayed on the LCD display by reducing the backlight luminance and timely compensating the gray scale value of the LCD molecules to reduce power consumption. FIG. 2A shows a schematic diagram of the control apparatus 200 in accordance with a first embodiment of the present disclosure. The control apparatus 200, coupled to a backlight control circuit 215, comprises a reference value generator 205, a control value generator 210, and a compensation circuit 220. In this embodiment, each of backlight units comprises one or a plurality of LED components, and illuminates a corresponding pixel region. Accordingly, the control apparatus 200 respectively controls the backlight units to emit backlight with appropriate backlight luminance to corresponding pixel regions on the display panel, and adjusts pixel values of an input image V_IN corresponding to the pixel regions, so as to reduce power consumption. More specifically, as shown in FIG. 1, for a pixel region R of the input image V_IN and a backlight unit corresponding to the pixel region R, the reference value generator 205 generates a reference value P_R corresponding to the pixel region R and a pixel extremum P_E according to a plurality of pixel values of the input image V_IN corresponding to the pixel region R. In another embodiment, the pixel extremum P_E is generated according to a plurality of pixel values of the input image V_IN corresponding to the pixel region R and pixel regions adjacent to the pixel region R. The control value generator 210 generates a backlight control value V_C of a backlight unit corresponding to the pixel region R according to the reference value P_R and the pixel extremum P_E, and the backlight control circuit 215 generates a backlight control signal BL_CTRL according to the backlight control value V_C to control or adjust a backlight luminance BL of the backlight unit. The compensation circuit 220 adjusts the pixel values of the input image V_IN corresponding to the pixel region R to compensate a luminance of the input image V_IN corresponding to the pixel region R.

Figure 2B:
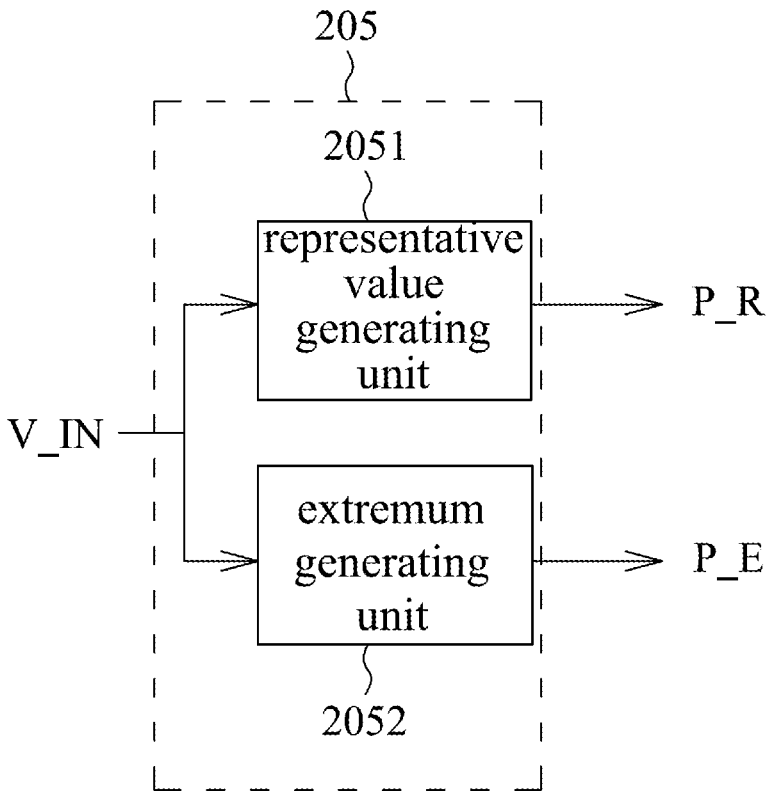
FIG. 2B is a block diagram of a reference value generator in FIG. 2A.

FIG. 2B shows a block diagram of the reference value generator 205 in FIG. 2A in accordance with an embodiment of the present disclosure. The reference value generator 205 comprises a representative value generating unit 2051 for generating a reference value P_R, and an extremum generating unit 2052 for generating a pixel extremum P_E. The reference value P_R may represent information of an overall pixel value distribution (i.e., a gray scale distribution), an overall pixel value variation or overall pixel value information of the input image V_IN corresponding to the pixel region R. The representative value generating unit 2051 can calculate the reference value P_R via approaches below. For example, in an embodiment, the representative value generating unit 2015 calculates an average value of the pixel values of the input image V_IN corresponding to the pixel region R, and the average value is regarded as the reference value P_R. In another embodiment, the representative value generating unit 2051 determines the reference value P_R according to a pixel value distribution of the input image V_IN corresponding to the pixel region R. For example, when the ratio of the plurality of pixel values of the input image V_IN corresponding to the pixel region R greater than a reference value is larger than a predetermined value, the representative value generating unit 2051 generates a larger reference value P_R; otherwise, when the ratio of the plurality of pixel values of the input image V_IN corresponding to the pixel region R greater than the reference value is smaller than the predetermined value, the representative value generating unit 2051 generates a smaller reference value P_R. Note that the foregoing approaches for calculating the reference value P_R and associated variations are within the scope and spirit of the present disclosure. Other than that, the foregoing pixel extremum P_E in this embodiment is designed as comprising a maximum pixel value, and the extremum generating unit 2052 compares the pixel values of the input image V_IN corresponding to the pixel region R one after another to select a pixel value having a maximum value as the maximum pixel value.

Since a luminance of an image frame viewed from the pixel region R by human eyes is contributed by a transmittance (i.e., a gray scale value) of LCD molecules of the pixel region R and a backlight luminance of a backlight unit corresponding to the pixel region R, in order to reduce power consumption, the control apparatus 200 in this embodiment is designed as controlling the backlight unit with reference to a reference value P_R and a maximum pixel value of the input image V_IN corresponding to the pixel region R to reduce the luminance of backlight emitted from the backlight unit, and correspondingly adjusting or compensating the pixel values of the input image V_IN corresponding to the pixel region R. An object of controlling the backlight unit with reference to the maximum pixel value is to avoid over-darkening the backlight emitted from the backlight unit, as the over-darkened backlight may cause complications in subsequent compensation of the pixel values. For example, in this embodiment, the maximum pixel value is for limiting a reduction range for the backlight luminance to maintain a minimum luminance of backlight emitted from the backlight unit, so as to avoid data overflow that may occur when the compensation circuit 220 compensates the pixel values. When the maximum pixel value is relatively small, it means that the pixel values of the input image V_IN corresponding to the pixel region R are relatively small, and thus the pixel values may be increasingly compensated in a large compensation range and may also be decreasingly adjusted in a large backlight luminance range. Otherwise, when the maximum pixel value is relatively large, the pixel values may be increasingly compensated only in a small compensation range and may also be decreasingly adjusted only in a small backlight luminance range. Accordingly, the control value generator 210 adaptively limits the backlight control value V_C to reduce the maximum luminance of backlight emitted from the backlight unit with reference to the maximum pixel value, so as to avoid data overflow. As observed from the abovementioned description, the maximum pixel value in this embodiment is inversely correlated with the backlight luminance range of the backlight unit decreasingly adjusted by the backlight control circuit 215.

By taking a diffusion property of light into consideration, backlight units of pixel regions adjacent to the pixel region R may undesirably affect the overall luminance of the pixel region R. Therefore, in another embodiment, the adjacent pixel regions are taken into consideration to calculate the maximum pixel value. The reference value generator 205 calculates or selects various maximum pixel values of the pixel region R and the adjacent pixel regions, and then selects one maximum value from the maximum pixel values. In other words, when the luminance of the pixel region R is increased due to backlight emitted from one adjacent pixel unit being in maximum brightness, the reference value generator 205 increases the maximum pixel value with reference to the various maximum pixel values of the adjacent pixel regions, so that the backlight unit is only allowed to decreasingly adjust in a small backlight luminance range—such design not only conforms to the physical property of light diffusion but also lowers the possibility of data overflow. The adjacent pixel regions may be, for example, 3×3=9 pixels adjacent to the pixel region R; however, all other selections of adjacent pixel regions are within the scope of the present disclosure.

Under normal circumstances, the backlight units of the display 100 emit backlight with maximum brightness. When the control apparatus 200 is targeted for power saving, for an adjusting mechanism of a backlight luminance BL of a backlight unit, the control value generator 210 reduces a generated backlight control value V_C to be lower than a backlight control value corresponding to the condition that backlight units are in maximum brightness, and the backlight control circuit 215 generates the backlight control signal BL_CTRL according to the backlight control value V_C to weaken the backlight luminance BL of the backlight unit. Different from the foregoing embodiments, the control value generator 210 generates different backlight control values V_C according to a reference value P_R to determine a reduction level of the backlight luminance BL, i.e., the reduction level of the backlight luminance BL is determined according to overall gray scale information (brightness and darkness information) of the input image V_IN corresponding to the pixel region R. When the reference value P_R is relatively small, it means that most pixel values or gray scale values of the input image V_IN corresponding to the pixel region R are relatively small (i.e., the input image V_IN corresponding to the pixel region R is relatively dark), and thus the control value generator 210 generates a backlight control value V_C corresponding to a relatively large backlight adjustment (i.e., reduction) amount, and the backlight control circuit 215 generates a backlight control signal BL_CTRL according to the current backlight control value V_C to reduce the backlight luminance of the backlight unit. At this point, the backlight luminance BL of the backlight unit is substantially weakened according to the backlight control value V_C corresponding to the relatively large backlight adjustment (i.e., reduction) amount. When the reference value P_R is relatively large, it means that most pixel values or gray scale values of the input image V_IN corresponding to the pixel region R are relatively large (i.e., the input image V_IN corresponding to the pixel region R is relatively bright), and thus the control value generator 210 generates a backlight control value V_C corresponding to the relatively small backlight adjustment (i.e., reduction) amount, and the backlight control circuit 215 generates a backlight control signal BL_CTRL according to the current backlight control value V_C to reduce the backlight luminance of the backlight unit. At this point, the backlight luminance BL of the backlight unit is slightly weakened according to the backlight control value V_C corresponding to the relatively small backlight adjustment (i.e., reduction) amount. Accordingly, in this embodiment, the reference value P_R is inversely correlated with the backlight control value V_C.

Compensation, performed by the compensation circuit 220, for the input image V_IN, is represented by Equation 1:

$$Y' \times BL_P = Y \times BL_\text{full} \tag{1}$$

where Y' is a compensated pixel value, BL_P is a reduced backlight luminance, Y is an uncompensated pixel value, and BL_full is an unreduced backlight luminance (supposing that the backlight with the unreduced backlight luminance is in maximum brightness). Equation 1 represents that, the compensated pixel value Y' and the reduced backlight luminance BL_P need to contribute a same level of luminance as that of the uncompensated pixel value Y and the unreduced backlight luminance BL_full, such that abnormalities of the image frame are not easily observed by human eyes. Therefore, according to Equation 1, the compensation unit 220 calculates the compensated pixel value Y' based on Equation 2:

$$Y' = \frac{Y \times \text{BL_full}}{\text{BL_P}} \tag{2}$$

According to Equation 2, the compensation unit 220 calculates compensated or adjusted values of the pixel values of the input image V_IN corresponding to the pixel region R to correspondingly adjust the initial pixel values of the input image V_IN corresponding to the pixel region R, such that the luminance of input image V_IN corresponding to the pixel region R is compensated.

More specifically, the compensation circuit 220 comprises a calculating unit 225 and an adjusting unit 230. Considering the diffusion property of light, the backlight units of the adjacent pixel regions may undesirably affect the overall luminance of the pixel region R. Accordingly, the calculating unit 225 of the compensation circuit 220 estimates a backlight luminance BL_P corresponding to each of the pixels within the pixel region R according to the backlight control value V_C and a plurality of backlight control values corresponding to the plurality of backlight units of the adjacent pixel regions. After that, the adjusting unit 230 of the compensation circuit 220 adjusts each of the pixel values of the input image V_IN corresponding to the pixel region R using Equation 2 to compensate luminance of the pixel values of the input image V_IN corresponding to the pixel region R on the display 100. In the foregoing description, the pixel region is for illustrating the spirit of the present disclosure, and in practice, the backlight luminance of each of the backlight units of the display 100 and each of the pixel values of the input image V_IN corresponding to each of the backlight units may be controlled and adjusted by the control apparatus 200 to display a real luminance of the input image V_IN via each of the pixels cooperated with each of the backlight units.

In addition, in another embodiment of the present disclosure, in order to enhance the dynamic contrast of the display 100, the control apparatus 200 darkens dark components and brightens bright components of the input image V_IN by properly controlling the backlight luminance of the backlight units to increase luminance contrast of the whole image. For example, when LCD molecules of the pixel region R have a 10-bit gray scale (i.e., the backlight luminance has 1024 gradations), human eyes can observe an image having a 20-bit luminance contrast by properly controlling the backlight luminance of the backlight units and adjusting the pixel values of the input image V_IN. At this point, the control apparatus 200 is designed as increasing or reducing the backlight luminance of the backlight units and correspondingly adjusting the pixel values of the pixel region R. Therefore, the foregoing pixel value P_E in this embodiment has a maximum pixel value and a minimum pixel value to limit a maximum luminance and a minimum luminance. An approach for generating the minimum pixel value is similar to that of the maximum luminance, the reference value generator 205 compares the pixel values of the input image V_IN one after another to select a pixel value having a minimum value as the minimum pixel value, or selects a minimum value from minimum values of the pixel region R and the adjacent pixel regions as the minimum pixel value, and modifications thereof are within the spirit and scope of the present disclosure. In this embodiment, an objective of controlling the backlight luminance of the backlight units with reference to the minimum pixel value is to avoid over brightening backlight emitted from the backlight units, as over-brightened backlight may cause complications in subsequent compensation processing on pixel values, i.e., in this embodiment, the minimum pixel value is for limiting a backlight luminance range of increasingly adjusting the backlight, such that the problem that the input image V_IN is not rendered with apparent differences by over brightening the backlight luminance as well as relatively reducing the pixel values is avoided. The control value generator 210 adaptively limits a minimum value and a maximum value of the backlight control value V_C with reference to the maximum pixel value and the minimum pixel value in order to avoid over darkening or over brightening the backlight luminance.

Figure 4:
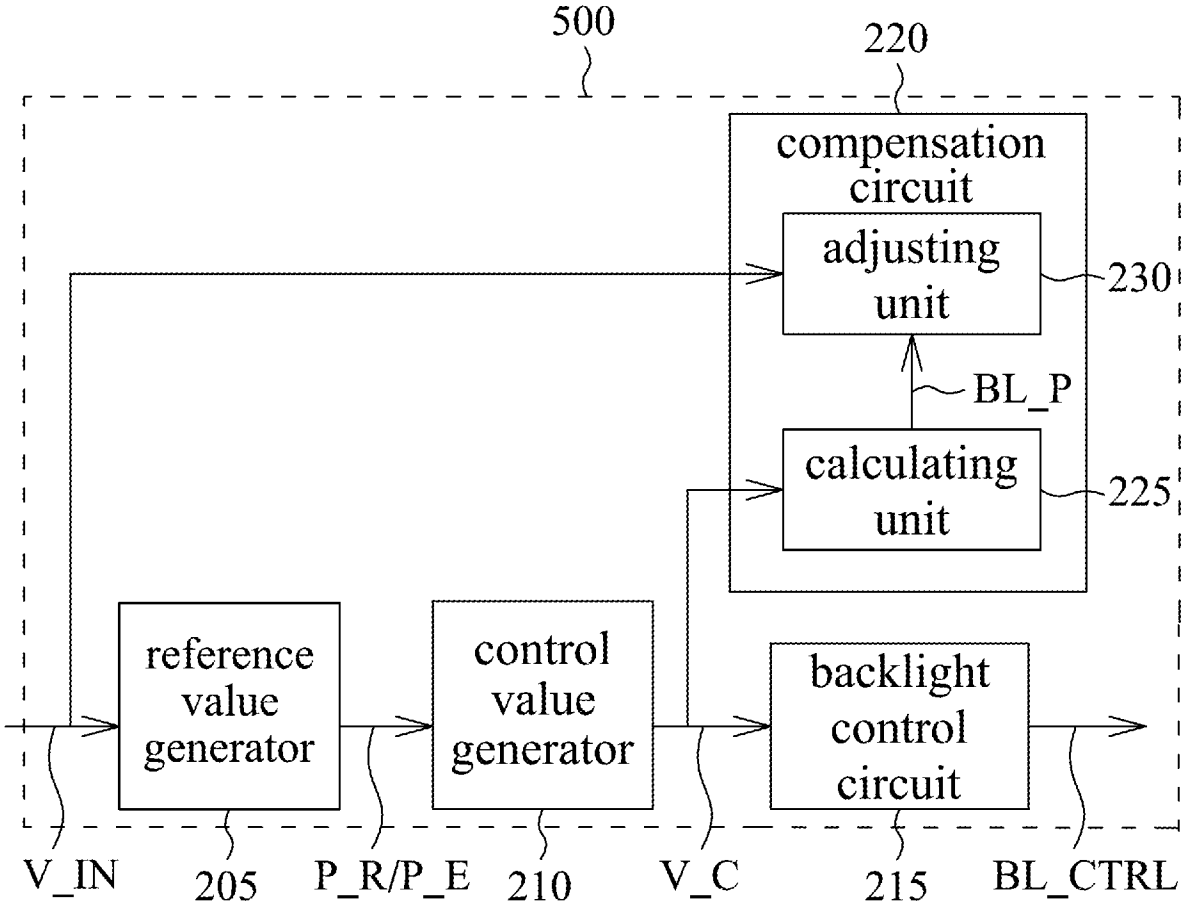
FIG. 4 is a block diagram of a control apparatus in accordance with another embodiment of the present disclosure.

In applications of increasing dynamic contrast, the control value generator 210 generates the backlight control value V_C according to the reference value P_R and the pixel extremum P_E generated by the reference value generator 205. More specifically, the control value generator 210 estimates the overall luminance of the input image V_IN corresponding to the pixel region R according to the reference value P_R in order to correspondingly generate a proper backlight control value V_C. For example, when the overall luminance of the input image V_IN corresponding to the pixel region R is relatively high, the backlight unit R has a relative high backlight luminance according to the backlight control value V_C generated by the control value generator 210; otherwise, when the overall luminance of the input image V_IN corresponding to the pixel region R is relatively low, the backlight unit R has a relative low backlight luminance according to the backlight control value V_C generated by the control value generator 210. The compensation circuit 220 obtains or calculates the compensated or adjusted pixel values of the input image V_IN corresponding to the pixel region R using Equation 3:

$$Y''\times BL_P=L \tag{3}$$

where Y" is a compensated pixel value of the input image V_IN corresponding to a target pixel of the pixel region R, BL_P is a backlight luminance emitted upon the target pixel, and L is a display luminance of the target pixel wished to be displayed by the display 100, i.e., L is a luminance, of the input image V_IN, displayed by the target pixel, and L is obtained via an uncompensated initial pixel value Y of the input image V_IN corresponding to the target pixel. Under a condition that the display luminance L is obtained, the calculating unit 225 of the compensation circuit 220 estimates backlight luminance BL_P corresponding to each of the pixels within the pixel region R according to a backlight control value V_C of a backlight unit corresponding to the pixel region R, and a plurality of backlight control values of a plurality of backlight units adjacent to the backlight unit. The adjusting unit 230 of the compensation circuit 220 adjusts each of the pixel values of the input image V_IN corresponding to the pixel region R using Equation 3 according to the backlight luminance BL_P. Therefore, the compensation circuit 220 adjusts the initial pixel values of the input image V_IN corresponding to the pixel region R, such that the display 100 displays the input image V_IN with the desired display luminance L. In another embodiment, referring to FIG. 4, a control apparatus 500 also comprises the backlight control circuit 215, i.e., in practice, the backlight control circuit 215 for controlling backlight units may be within the control apparatus 500, and modifications thereof are within the spirit and scope of the present disclosure.

Figure 3:
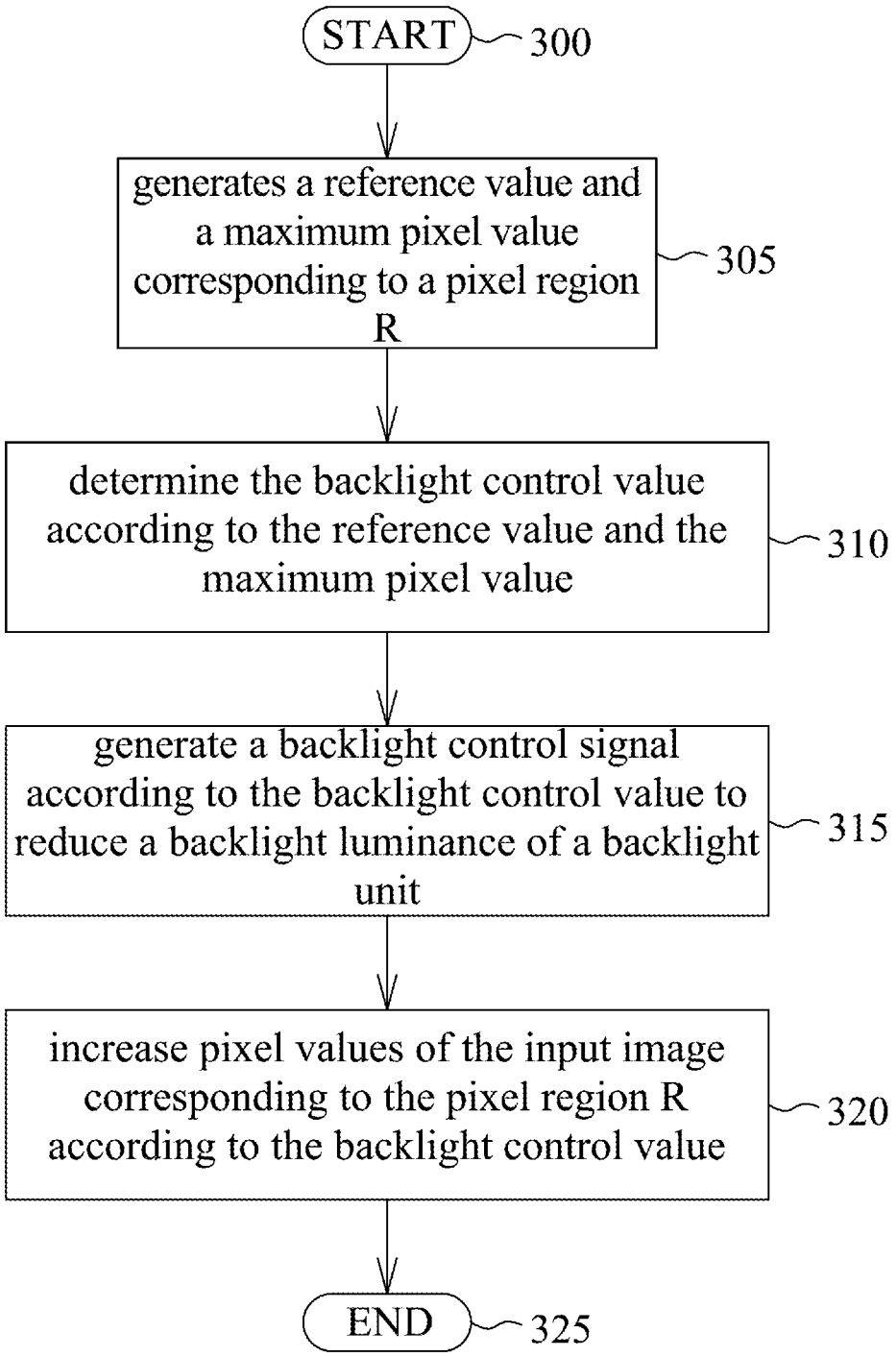
FIG. 3 is a flow chart of operations of the control apparatus in FIG. 2A when reducing a backlight luminance.

FIG. 3 shows a flow chart of operations of the control apparatus 200 implemented in power reducing applications. It is to be noted that, the steps in the flow chart need not be executed as the sequence shown in FIG. 3 nor be successive, provided that the same result is substantially achieved; that is to say, the steps in FIG. 3 can be interleaved with other steps. The steps are described below in detail.

The flow begins with Step 300. In Step 305, the reference value generator 205 generates a reference value P_R and a maximum pixel value according to a plurality of pixel values of an input image V_IN corresponding to a pixel region R. In Step 310, the control value generator 210 determines a minimum value of a backlight control value V_C according to the maximum pixel value, and determines the backlight control value V_C according to the reference value P_R. In Step 315, the backlight control circuit 215 generates a backlight control signal BL_CTRL according to the backlight control value V_C to reduce a backlight luminance BL of a backlight unit. In Step 320, the compensation circuit 220 increases pixel values of the input image V_IN corresponding to the pixel region R according to the backlight control value V_C, so as to compensate a luminance of the pixel region R. The flow ends in Step 325.

In conclusion, a control apparatus provided by the present disclosure is capable of dynamically adjusting backlight luminance of backlight units, and compensating pixel values of a corresponding input image, so as to reduce power consumption and enhance dynamic contrast.

While the present disclosure has been described in terms of what is presently considered to be the most practical and preferred embodiments, it is to be understood that the present disclosure needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. An apparatus for controlling a display having a backlight module provided with a first set of backlight units and a display panel provided with a second set of pixel units, the apparatus comprising:

a reference value generator that generates:

a reference value representative of a portion of pixels contained in an input image associated with one of the second set of pixel units of the display panel, and a maximum pixel value generated by selecting a maximum value from pixel values of the portion of pixels contained in the input image;

a control value generator that generates a backlight control value, in view of the reference value and the maximum pixel value, to control one of the first set of backlight units, the one of the first set of backlight units being associated with the one of the second set of pixel units; and a compensation circuit that adjusts the portion of pixels contained in the input image in view of the backlight control value, wherein the compensation circuit comprises:

a calculating unit that estimates a backlight luminance corresponding to a target unit of the one of the second set of pixel units, in view of a plurality of backlight control values of individual ones of the first set of backlight units that are adjacent to the one of the first set of backlight units, for considering a diffusion property of light, and the backlight control value, and an adjusting unit that adjusts a pixel value of the portion of pixels contained in the input image associated with the target unit according to the backlight luminance to provide an adjusted pixel value, wherein the maximum pixel value is used, by the control value generator, to limit a minimum luminance of the one of the first set of backlight units, and wherein the compensation circuit calculates the adjusted pixel value according to an equation which is expressed as follows:

$$Y'=Y\times BL\ \text{full}/BL\ P,$$

wherein:

Y' is the adjusted pixel value,

Y is the pixel value before adjusting,

BL full is the luminance of the one of the first set of backlight units before reducing, and BL P is the backlight luminance corresponding to the target unit of the one of the second set of pixel units.

2. The apparatus as claimed in claim 1, further comprising:

a backlight control circuit that generates a backlight control signal according to the backlight control value to control the one of the first set of backlight units.

3. The apparatus as claimed in claim 1, wherein the reference value generator calculates an average value of the portion of pixels contained in the input image to generate the reference value.

4. The apparatus as claimed in claim 1, wherein the reference value generator determines the reference value according to a pixel value distribution of the portion of pixels contained in the input image.

5. The apparatus as claimed in claim 1, wherein when the backlight control value is for reducing luminance of the one of the first set of backlight units, the compensation circuit correspondingly increases pixel values of the portion of pixels contained in the input image according to a range in which the luminance of the one of the first set of backlight units is reduced.

6. The apparatus as claimed in claim 1, wherein when the backlight control value is for reducing luminance of the one of the first set of backlight units, the maximum pixel value is inversely correlated with a range in which the luminance of the one of the first set of backlight units is reduced in view of the backlight control value.

7. The apparatus as claimed in claim 1, wherein the display is a liquid crystal display (LCD), and the backlight module comprises light emitting diodes (LEDs).

8. A method for controlling a display having a backlight module provided with a first set of backlight units and a display panel provided with a second set of pixel units, the method comprising:

generating a reference value representative of a portion of pixels contained in an input image associated with one of the second set of pixel units of the display panel;

generating a maximum pixel value by selecting a maximum value from pixel values of the portion of pixels contained in the input image;

generating a backlight control value, in view of the reference value and the maximum pixel value, to control one of the first set of backlight units, the one of the first set of backlight units being associated with the one of the second set of pixel units, wherein the maximum pixel value is used to limit a minimum luminance of the one of the first set of backlight units; and adjusting the portion of pixels contained in the input image in view of the backlight control value, wherein the step of adjusting the portion of pixels contained in the input image in view of the backlight control value comprises:

estimating a backlight luminance corresponding to a target unit of the one of the second set of pixel units, in view of a plurality of backlight control values of individual ones of the first set of backlight units that are adjacent to the one of the first set of backlight units, for considering a diffusion property of light, and the backlight control value; and adjusting a pixel value of the portion of pixels contained in the input image associated with the target unit according to the backlight luminance to provide an adjusted pixel value, wherein the adjusting of the pixel value of the portion of pixels contained in the input image associated with the target unit according to the backlight luminance to provide an adjusted pixel value comprises calculating the adiusted pixel value according to an equation which is expressed as follows:

$$Y'=Y\times BL\ \text{full}/BL\ P,$$

wherein:

Y' is the adjusted pixel value,

Y is the pixel value before adjusting,

BL full is the luminance of the one of the first set of backlight units before reducing, and BL P is the backlight luminance corresponding to the target unit of the one of the second set of pixel units.

9. The method as claimed in claim 8, wherein the generating the reference value representative of the portion of pixels contained in the input image associated with the one of the second set of pixel units comprises:

calculating an average value of the portion of pixels contained in the input image to generate the reference value.

10. The method as claimed in claim 8, wherein the generating the reference value representative of the portion of pixels contained in the input image associated with the one of the second set of pixel units comprises:

determining the reference value according to a pixel value distribution of the portion of pixels contained in the input image.

11. The method as claimed in claim 8, wherein when the backlight control value is for reducing luminance of the one of the first set of backlight units, pixel values of the portion of pixels contained in the input image are correspondingly increased according to a range in which the luminance of the one of the first set of backlight units is reduced.

12. The method as claimed in claim 8, wherein when the backlight control value is for reducing the luminance of the one of the first set of backlight units, the maximum pixel value is inversely correlated with the a range in which the luminance of the one of the first set of backlight units is reduced.

13. The apparatus as claimed in claim 1, wherein the reference value generator further generates a minimum pixel value by selecting a minimum value from pixel values of the portion of pixels contained in the input image, wherein the control value generator generates the backlight control value in view of the reference value, the maximum pixel value, and the minimum pixel value, and wherein the minimum pixel value is used to limit a maximum luminance of the one of the first set of backlight.

14. The method as claimed in claim 8, further comprising:

generating a minimum pixel value by selecting a minimum value from pixel values of the portion of pixels contained in the input image;

wherein the backlight control value is generated in view of the reference value, the maximum pixel value, and the minimum pixel value; and the minimum pixel value is used to limit a maximum luminance of the one of the first set of backlight.

* * * * *